US005078285A

United States Patent [19]

Geyer et al.

[11] Patent Number: 5,078,285

[45] Date of Patent: Jan. 7, 1992

[54] DRAGLINE MODULAR SWING DRIVE UNIT

[75] Inventors: Allan E. Geyer, Marion, Ohio; Richard W. McCoy, Granger, Ind.; James A. Ehret, Prospect; Dev R. Malik, Marion, both of Ohio

[73] Assignee: Dresser Industries, Inc., Dallas, Tex.

[21] Appl. No.: 469,295

[22] Filed: Jan. 24, 1990

[51] Int. Cl.[5] ..... B66C 23/84

[52] U.S. Cl. ..... 212/247; 212/245; 212/253; 74/421 A; 475/149

[58] Field of Search ..... 74/421 A, 421 R; 475/149, 153; 212/247, 248

[56] References Cited

U.S. PATENT DOCUMENTS

| | | | |
|---|---|---|---|
| 792,974 | 10/1904 | Douglas | 74/421 R |
| 1,617,941 | 1/1925 | Crawford | 212/248 |
| 1,886,032 | 4/1931 | Lotte | 74/421 R |
| 1,945,361 | 11/1932 | Ball | 74/421 A |
| 2,377,448 | 6/1945 | Porter | 212/247 |
| 2,974,538 | 3/1961 | Jennings | 74/421 R |
| 3,133,452 | 5/1964 | Coutant et al. | 74/421 R |
| 3,207,002 | 1/1965 | Larin et al. | 74/665 |
| 3,373,626 | 3/1968 | Maurer et al. | 74/421 R |
| 3,481,222 | 6/1968 | Baron | 74/802 |
| 3,739,652 | 6/1973 | Caldwell et al. | 74/421 A |
| 3,811,577 | 5/1974 | Yancey | 212/247 |
| 3,861,243 | 1/1975 | Fleischer | 74/805 |
| 3,961,713 | 6/1976 | Stine | 212/248 |
| 4,098,139 | 7/1978 | Sankey | 74/410 |
| 4,231,699 | 11/1980 | Thompson | 414/687 |
| 4,307,621 | 12/1981 | Merron | 74/421 A |
| 4,371,086 | 2/1983 | Sankey et al. | 212/253 |
| 4,951,261 | 8/1990 | Strehlow | 74/421 A |

FOREIGN PATENT DOCUMENTS

| | | | |
|---|---|---|---|
| 0972988 | 8/1975 | Canada | 74/421 A |
| 1263614 | 10/1986 | U.S.S.R. | 212/247 |

*Primary Examiner*—Leslie A. Braun
*Assistant Examiner*—Daniel Wittels
*Attorney, Agent, or Firm*—Ross, Howison, Clapp & Korn

[57] ABSTRACT

In an excavating machine having a ring gear and a rotating frame including a top and bottom plate, an assembly for rotating the frame relative to the ring gear includes a plurality of drive units, each of the drive units is mounted to the bottom plate and is disposed between the top and bottom plates of the rotating frame. Each of the drive units further includes a pinion extending below the bottom plate and adjacent to the ring gear for driving engagement with the ring gear.

11 Claims, 2 Drawing Sheets

DRAGLINE MODULAR SWING DRIVE UNIT

TECHNICAL FIELD OF THE INVENTION

The present invention relates to excavators such as draglines and stripping shovels, and more particularly to a swing drive unit for a rotatable frame of such excavators.

BACKGROUND OF THE INVENTION

In most conventional types of heavy-duty excavating machines of the dragline or stripping shovel type, there is usually provided a rotatable frame having a top deck and a bottom plate. A stationary ring gear is mounted to a base of a crawler unit or to a tub which is supported on the ground adjacent to or in a pit of a surface mine. The rotating frame supports at least one drive unit, having a pinion drivingly engageable with the ring gear which operates to swing the rotatable frame. Traditionally, such swing drive units have been mounted on the top deck with the pinion shaft thereof extending through vertical openings in the rotating frame. These existing designs incorporate a long main rotating shaft which connects the gear case mounted on the top deck of the rotating frame to the main rotating pinion located below the bottom plate of the rotating frame. The long main rotating shaft is subject to torsional windup which can cause unbalanced motor load sharing. Severe vibrational problems can also occur in this condition. The overhung main rotating pinion loads also cause the main rotating shaft to deflect in bending sufficiently that the pinion teeth must be heavily crowned to compensate for this misalignment. Additionally, such mounting arrangements have been found not to be entirely satisfactory in that configurations require precise machining of the rotating frame for mounting the swing unit and assuring proper alignment of the pinion shaft with the ring gear.

The precise machining of the rotatable frame and the alignment of the pinion shaft with the ring gear involves a comparatively high manufacturing cost. It is highly desirable to provide a swing drive unit for an excavator which can be effectively and economically installed in the machine in the field and properly aligned with the ring gear of the machine to provide full bearing contact between the teeth of the meshing gears and which provides maximum efficiency in torque transmission.

A need has thus arisen for a swing drive unit for an excavating machine which minimizes torsional windup and eliminates shaft bending deflection thereby providing improved tooth contact between the pinion and ring gear. A need has further arisen for an improved swing drive unit which is modular in construction for easy removal for servicing in the field.

SUMMARY OF THE INVENTION

In accordance with the present invention, in an excavating machine having a ring gear and a rotating frame including a top and bottom plate, an assembly for rotating the frame relative to the ring gear is provided. The assembly includes a plurality of drive units, each of the drive units is mounted to the bottom plate and is disposed between the top and bottom plates of the rotating frame. Each of the drive units further includes a pinion extending below the bottom plate and adjacent to the ring gear for driving engagement with the ring gear.

In accordance with another aspect of the present invention, the drive unit includes a planetary gear assembly mounted to a housing which is selectably mounted to the bottom plate for easy removal therefrom.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DETAILED DESCRIPTION OF THE INVENTION

Figure 1:
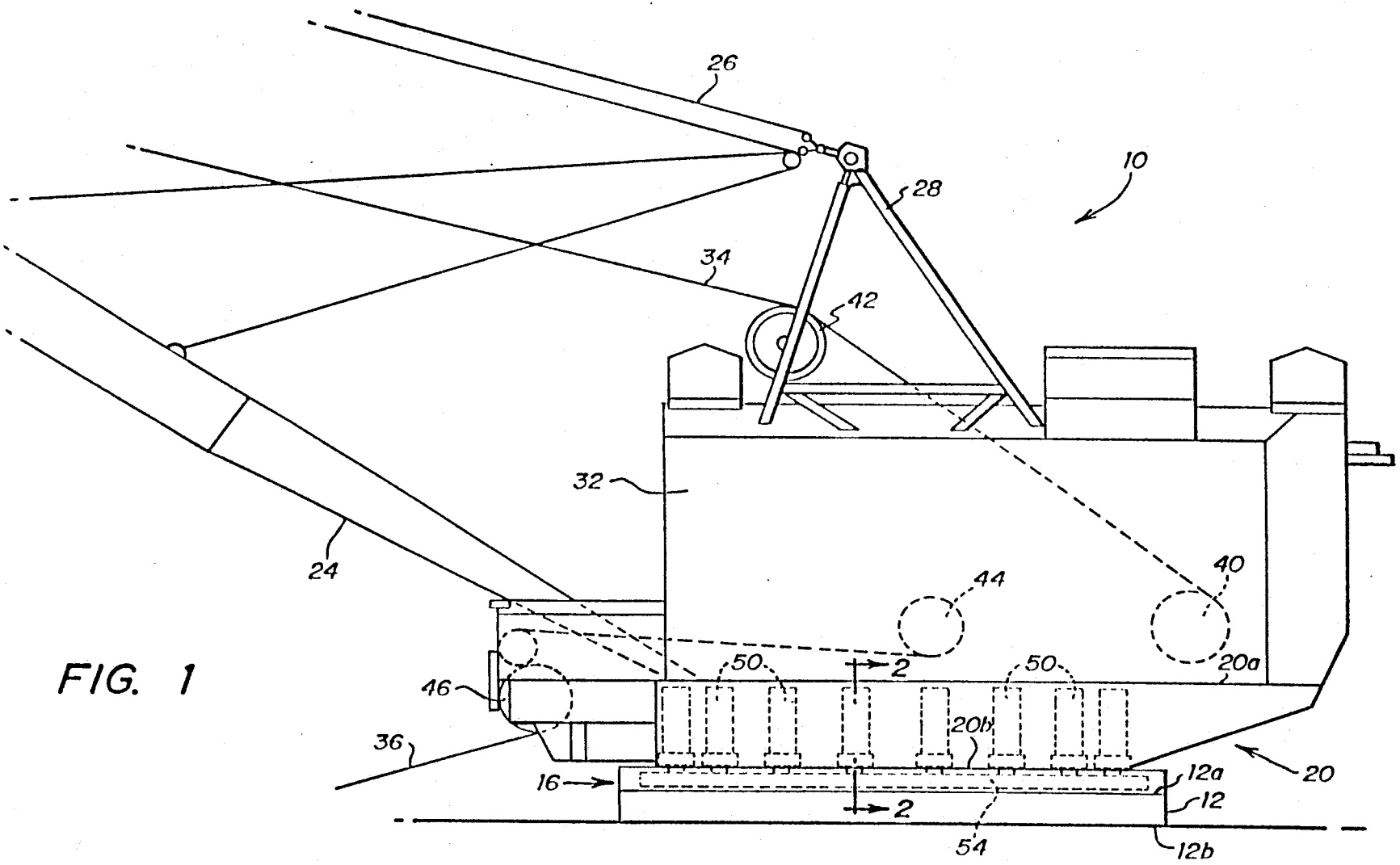
FIG. 1 is a side elevational view of an excavating machine utilizing the swing drive units of the present invention.
Figure 2:
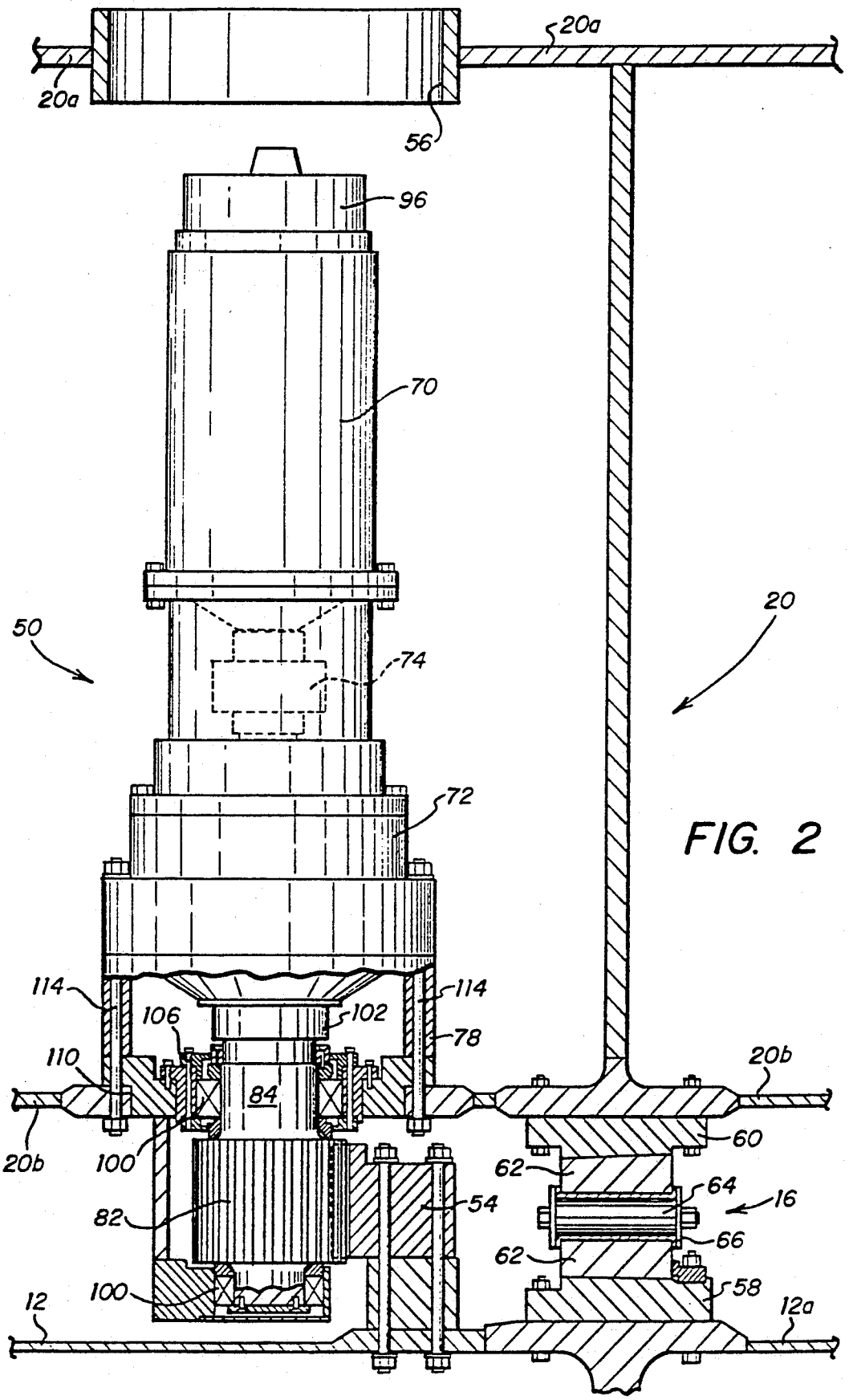
FIG. 2 is an enlarged cross sectional view taken generally along sectional lines 2—2 of FIG. 1.

Referring simultaneously to FIGS. 1 and 2, a dragline machine, generally identified by the numeral 10 is illustrated. Dragline machine 10 is illustrated for stationary operation and is mounted in a tub 12, having a top plate **12*a* and bottom plate 12*b*; however, it is understood that the present invention can also be utilized on a dragline machine which incorporates a crawler unit. Dragline machine 10 includes a live roller circle, generally identified by the numeral 16 which supports a rotating frame assembly, generally identified by the numeral 20**.

Connected to rotating frame assembly 20 is a boom 24 which is supported at its outer end or point by pendants 26 secured to the upper end of a gantry 28. Gantry 28 is mounted to rotating frame assembly 20, and is partially enclosed by a housing 32. Also disposed within housing 32 and supported on rotating frame assembly 20 is hoist and drag machinery which operates hoist lines 34 and drag lines 36. Hoist lines 34 are wound on a hoist drum 40, extend upwardly, over a set of sheaves 42 mounted on the front legs of gantry 28, extend forwardly, over and around a set of boom point sheaves and extend downwardly to where they are connected to a drag line bucket (not shown). Drag lines 36 are wound on a drag line drum 44, extend forwardly and over and around a set of fairlead sheaves 46 and extend forwardly where they are operatively connected to the front end of the drag line bucket.

Dragline machine 10 includes a plurality of swing drive units of the present invention, generally identified by the numeral 50. Swing drive unit 50 is utilized for causing rotation of rotating frame assembly 20 through engagement with a stationary ring gear 54 which is mounted to tub 12. Rotating frame assembly 20 includes a top deck **20*a* having an aperture 56 and a bottom plate 20*b***.

Referring now to FIG. 2, rotating frame assembly 20, as previously stated, is supported on live roller circle 16 at bottom plate **20*b*. Ring gear 54 is disposed concentrically with live roller circle 16 on tub 12. Live roller circle 16 includes a lower circular rail 58 mounted on tub 12, an upper circular rail 60 mounted on the underside of bottom plate 20*b* of rotating frame assembly 20 and a plurality of rollers 62. Rollers 62 are supported on shafts 64 by a cage assembly 66. Rollers 62 are supported on lower circular rail 58 and upper circular rail 60 is supported on rollers 62 so that rotating frame assembly 20 can be rotated or swung relative to tub 12 about the vertical central line of live roller circle 16**.

Each of swing drive units 50 are mounted to rotating frame assembly 20 in accordance with the present invention through aperture 56 and between top deck 20*a* and bottom plate 20*b*. Any suitable number of swing drive units 50 can be utilized with a dragline machine 10 determined by the machine size and required swing torque. Swing drive unit 50 includes a vertical electric motor 70 mounted on top of a planetary gear case 72 through a grid coupling 74. Planetary gear case 72 is mounted on a removable housing 78 which contains a main rotating pinion 82 mounted on a rotating shaft 84. Pinion 82 is disposed in driving engagement with ring gear 54 and extends below bottom plate 20*b* of rotating frame assembly 20.

Electric motor 70 is located on a support which is integral with planetary gear case 72 by a pilot register (not shown). A disk brake 96 is mounted on the top of motor 70. Motor 70 drives an input shaft (not shown) of planetary gear case 72 through grid coupling 74. Pinion shaft 84 is supported in housing 78 through antifriction bearings 100. The output of planetary gear case 72 drives pinion shaft 84 by a spline connection 102. Pinion shaft 84 utilizes a top bearing cartridge assembly 106. Housing 78 is located on bottom plate 20*b* of rotating frame assembly 20 by a pilot register 110. Planetary gear case 72, housing 78 and bottom plate 20*b* of rotating frame assembly 20 are interconnected by tensioned fasteners 114. Actuation of motor 70 causes driving engagement of pinion 82 with ring gear 54 to cause rotating frame assembly 20 to rotate relative to tub 12 in a conventional manner in order to swing rotating frame assembly 20.

Because swing drive unit 50 is mounted between top deck 20*a* and bottom plate 20*b* of rotating frame assembly 20, the length of pinion shaft 84 can be significantly decreased resulting in a compact swing drive unit 50 thereby minimizing torsional windup. Swing drive unit 50 being mounted to bottom plate 20*b* of rotating frame assembly 20 through housing 78 and straddle bearings 100 significantly eliminates the bending deflection of pinion shaft 84. Any misalignment between pinion 82 and ring gear 54 becomes a function of the stiffness of bottom plate 20*b* of rotating frame assembly 20. The modular arrangement of the present swing drive unit 50 including planetary gear case 72 and housing 78 provides for easy maintenance in the field. For example, planetary gear case 72 can be quickly replaced by a completely assembled spare planetary gear case 72 which is more economical to stock than previously existing entire larger parallel shaft gear cases. With the use of the present planetary gear case 72, it is possible to place more total swing horsepower on rotating frame assembly 20 than was able with previously existing swing drive units. With the increased total swing horsepower provided by the present swing drive unit 50, the dragline machine 10 can be productive even when less than all the swing drive units are in operation.

The use of planetary gear case 72 in swing drive unit 50 allows drive units 50 to be smaller in size and weight than prior such drive units. Because drive units 50 are smaller, and have a smaller combined footprint, a greater number of units can be utilized with dragline machine 10 which results in several advantages achieved by the present invention. One advantage is that the face width of ring gear 54 can be decreased. Further, because there are more meshing points at reduced loads between pinion 82 and ring gear 54, the size of the teeth of ring gear 54 can be made smaller.

It therefore can be seen that the present invention provides for an improved swing drive unit for a dragline machine in which the swing drive unit is mounted between the top deck and bottom plate of a rotating frame assembly to minimize the length of the pinion shaft thereby significantly decreasing torsional windup and shaft bending deflection.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. In an excavating machine having a roller circle supporting a rotating frame assembly, a ring gear disposed interiorly of and substantially coplanar with the roller circle and disposed below the rotating frame assembly, the rotating frame assembly disposed for rotation on the roller circle and including spaced top and bottom plates and a vertical roller circle support bulkhead secured to the plates, the vertical roller circle support bulkhead being located above the roller circle, an assembly for rotating the frame assembly relative to the ring gear comprising:

a drive unit having a first portion secured to and mounted on the rotating frame assembly and a second portion including a pinion gear having an axis of rotation, said pinion gear disposed interiorly of the roller circle, said pinion gear axis of rotation located interiorly of the vertical roller circle support bulkhead of the rotating frame assembly and said pinion gear further extending below the bottom plate of the rotating frame assembly and adjacent to the ring gear for driving engagement with the ring gear; and said drive unit first portion including a drive gear mechanism mounted so that torsional loads and other mechanical loads produced by said drive unit are primarily supported by the bottom plate of the rotating frame assembly and said drive gear mechanism being completely disposed between the top and bottom plates and adjacent to the bottom plate of the rotating frame assembly.

2. The assembly of claim 1 and further including:

a gear case selectively and independently mounting said first portion of said drive unit to the rotating frame assembly and being completely disposed between the top and bottom plates of the rotating frame assembly.

3. The assembly of claim 1 wherein said drive gear mechanism includes planetary gears.

4. The assembly of claim 2 wherein said gear case is mounted adjacent to the bottom plate of the rotating frame assembly.

5. The assembly of claim 2 wherein said gear case is mounted on the bottom plate of the rotating frame assembly.

6. In an excavating machine having a roller circle supporting a rotating frame assembly, a ring gear disposed interiorly of and substantially coplanar with the roller circle and disposed below the rotating frame assembly, the rotating frame assembly disposed for rotation on the roller circle and including spaced top and bottom plates and a vertical roller circle support bulkhead secured to the plates, the vertical roller circle support bulkhead being located above the roller circle, an assembly for rotating the frame assembly relative to the ring gear comprising:

at least three drive units, each of said drive units having a first portion secured to and mounted on the rotating frame assembly and a second portion including a pinion gear having an axis of rotation, said pinion gear disposed interiorly of the roller circle, said pinion gear axis of rotation located interiorly of the vertical roller circle support bulkhead of the rotating frame assembly and said pinion gear further extending below the bottom plate of the rotating frame assembly and adjacent to the ring gear for driving engagement with the ring gear;

each of said drive units first portions including a drive gear mechanism mounted so that torsional loads and other mechanical loads produced by said drive units are primarily supported by the bottom plate of the rotating frame assembly and said drive gear mechanism being completely disposed between the top and bottom plates and adjacent to the bottom plate of the rotating frame assembly; and at least two of said drive units operable to rotate the frame assembly upon failure of one or more of said drive units.

7. The assembly of claim 6 wherein each of said drive units includes:

a gear case selectively and independently mounting each of said first portions of said drive units to the rotating frame assembly and being completely disposed between the top and bottom plates of the rotating frame assembly.

8. The assembly of claim 6 wherein each of said drive gear mechanisms includes planetary gears.

9. The assembly of claim 7 wherein said gear case is mounted adjacent tot he bottom plate of the rotating frame assembly.

10. The assembly of claim 7 wherein said gear case is mounted on the bottom plate of the rotating frame assembly.

11. The assembly of claim 6 having at least twelve drive units mounted to the rotating frame assembly, such that the circumference of a circle passing through said twelve drive units is approximately equal to the circumference of the ring gear.

* * * * *